US008261473B2

(12) United States Patent
Bey et al.

(10) Patent No.: US 8,261,473 B2
(45) Date of Patent: Sep. 11, 2012

(54) VEHICLE HITCH APPARATUS AND SIGN CARRIER

(76) Inventors: Joshua A. Bey, Cedar Falls, IA (US); Sarah R. Bey, Cedar Falls, IA (US)

( * ) Notice: Subject to any disclaimer, the term of this patent is extended or adjusted under 35 U.S.C. 154(b) by 188 days.

(21) Appl. No.: 12/798,382

(22) Filed: Apr. 2, 2010

(65) Prior Publication Data

US 2010/0251584 A1 Oct. 7, 2010

Related U.S. Application Data

(60) Provisional application No. 61/211,998, filed on Apr. 6, 2009.

(51) Int. Cl.

| | |
|---|---|
| ***G09F 21/04*** | (2006.01) |
| ***G09F 7/00*** | (2006.01) |
| ***G09F 15/00*** | (2006.01) |
| ***G09F 15/02*** | (2006.01) |
| ***A47B 23/00*** | (2006.01) |
| ***A47B 65/00*** | (2006.01) |
| ***A47B 97/04*** | (2006.01) |
| ***A47B 96/00*** | (2006.01) |
| ***A47F 5/08*** | (2006.01) |

(52) U.S. Cl. ..... 40/591; 40/590; 40/593; 40/209; 40/606.01; 248/445; 248/450; 248/451; 248/441.1; 248/444; 248/220.1; 248/221.11; 248/222.14; 224/405; 224/499; 224/489; 224/488; 211/90.02; 211/90.03; 211/118

(58) Field of Classification Search ..... 40/591, 40/590, 693, 209, 606.01; 248/445, 450, 248/451, 441.1, 444, 220.1, 221.11, 222.14; 224/405, 499, 489, 488; 211/90.02, 90.03, 211/118

See application file for complete search history.

(56) References Cited

U.S. PATENT DOCUMENTS

| | | | | |
|---|---|---|---|---|
| 5,125,517 | A * | 6/1992 | Martinell | 211/18 |
| 6,666,465 | B2 * | 12/2003 | Chan | 280/47.26 |
| 7,503,135 | B2 * | 3/2009 | Chafin | 40/591 |

* cited by examiner

*Primary Examiner* — Lesley D Morris
*Assistant Examiner* — Syed A Islam
(74) *Attorney, Agent, or Firm* — McKee, Voorhees & Sease, P.L.C.

(57) ABSTRACT

The present invention relates to a sign carrier apparatus specifically designed to be inserted into a vehicle hitch assembly to transport signs. Alternatively, the present invention provides for a free standinged receiver hitch, or free standing receiver hitch for storing the sign carrier apparatus when not in use.

22 Claims, 12 Drawing Sheets

BASKET AND HITCH ASSEMBLY 250

Note: All joints are bolted, except as identified otherwise

MOLDED BASKET AND HITCH ASSEMBLY 300

NOTE: ALL STRUCTURAL JOINTS ARE WELDED

◯ = BOLTED CONNECTION

BASKET AND HITCH ASSEMBLY 450

Note: All joints are welded, except as identified otherwise

□ = Pinned Joint - Locking

○ = Hinged Joint

BASKET AND HITCH ASSEMBLY 550

Note: All joints are bolted, except as identified otherwise

VEHICLE HITCH APPARATUS AND SIGN CARRIER

CROSS-REFERENCE TO RELATED APPLICATIONS

This application is a conversion of and claims priority to prior U.S. Provisional Patent Application Ser. No. 61/211,998, filed Apr. 6, 2009, entitled Vehicle Hitch Apparatus and Sign Carrier and is herein incorporated by reference.

BACKGROUND OF THE INVENTION

1. Field of the Invention

The present invention relates to an apparatus specifically designed to be inserted into a vehicle hitch assembly to transport signs.

2. Problems in the Art

According to United States Department of Labor statistics, as of 2006 there were over 1 million real estate agents or brokers in the United States. These agents and brokers have a common problem, which is the easy transportation of real estate "for sale" and "open house" signs.

Typically, a real estate agent will use the trunk of their personal car, or the rear compartment of their personal SUV, mini-van, van or truck to transport real estate signs to designate a particular property is for sale, or to direct people to an open house. When an agent has an open house, they may transport a dozen or more signs in their car, SUV, or van, in order to place the signs in strategic places to direct potential buyers to the open house. Of course, when the open house is over, the temporarily placed signs have to be retrieved and put back into the agent's personal vehicle. The signs are generally dirty from being placed in the ground or from inclement weather, or may have a significant amount of dirt and mud that will collect on the sign legs from being driven into the ground. The dirt and mud on the sign legs can easily fall off in the trunk or rear compartment area of the agent's personal vehicle, creating a mess. In addition, these signs slide from side-to-side and front-to-back making a constant noise, as well as scratching up the interior and hence, decreasing the value of the vehicle. Real estate signs are typically placed horizontally in a car, van or SUV, and can easily get tangled or intertwined, and consequently be unwieldy to handle. Also, the positions of the signs in a car trunk, SUV, or van rear compartment do not lend themselves to being in optimum ergonomic positions for loading and unloading. The real estate agent has to bend over to untangle and retrieve a sign, or to put a sign back into their personal vehicle, which puts undue stress on an agents' back from being in such a disadvantageous position for lifting, and also creates the inconvenience of opening and closing the vehicle door or end gate.

There are many specific types of carriers designed to fit in a receiver hitch on a vehicle.

One example is U.S. Pat. No. 6,382,487 to Stein, which describes a carrier for a trailer-hitch receiver that is designed to transport bicycles, skis and poles, canoes, canoe paddles and other cargo through the use of a vertical frame into which various rods may be placed, at locations most suited for the specific cargo. However, this invention has not been designed for transporting real estate or other like signs.

Another example of a hitch-mounted carrier is U.S. Pat. No. 6,634,702 to Agan, which describes a truck-bed extension adapted to attach to a truck with a truck gate and a hitch receiver. The truck-bed extension may also serve as a mobile work surface, such as a craftwork surface. However, this invention has not been designed for transporting real estate or other like signs.

Another example of a hitch-mounted carrier is U.S. Pat. No. 6,379,101 to Breaux, which describes a simple, inexpensive ramp and cargo system that is easily mounted to a standard trailer hitch socket of a vehicle with a rear door or hatch, including a minivan. The ramp can be used to load small sized wheeled vehicles, including occupied wheelchairs, into the interior of the vehicle. The ramp and cargo system is carried outside the vehicle and does not decrease the interior space of the vehicle. The ramp and cargo system can optionally serve as a deck attached to the rear of the vehicle to provide additional cargo space. This external deck can be expanded and partially enclosed with two platform pieces and sidewalls. The ramp and cargo system is inexpensive, light-weight, easy to install and remove, and easy to deploy as a ramp. However, this invention has not been designed for transporting real estate or other like signs.

Another example of a hitch-mounted carrier is U.S. Pat. No. 6,478,203 to Burns, which describes a carrier and hitch assembly that is large enough to contain a standard size golf bag and a complete set of clubs. The housing is provided with wheels and a handle so that the housing may be utilized in cart-like fashion. The rear face of the housing is provided with structure for attaching the housing to a hitch assembly for transporting the housing at the rear of an automotive vehicle or golf cart. However, this invention has not been designed for transporting real estate or other like signs.

Another example of a hitch-mounted carrier is U.S. Pat. No. 6,189,754 to Cutajar, et al, which describes a carrier for attachment to a motor home or vehicle for transporting small outboard motors and their associated gasoline tanks. The carrier has a generally rectangular base for a releasable attachment to a motor vehicle. The base has an outboard motor support for supporting an outboard motor in a position to maintain the propeller lower than the engine casing and a gasoline tank storage receptacle for securely transporting the gasoline tank for the outboard motor. However, this invention has not been designed for transporting real estate or other like signs.

A humorous example of a hitch-mounted apparatus is U.S. Pat. No. 6,125,480 to Soffar, et al, which describes an extension member that is attachable to a trailer hitch and extends away from the vehicle and is connected to a seating frame supporting a toilet seat. This toilet seat can be used by hunters, fisherman, campers, construction workers, boaters and other people who find themselves away from conventional bathroom facilities. However, this invention has not been designed for transporting real estate or other like signs.

Another example of a hitch-mounted apparatus is U.S. Pat. No. 7,156,273 to Morris, which describes a convertible cargo container system having individual components that provide a table or work surface. The cargo container system includes a pair of foldable side panels and a pair of rigid end panels coupled to the ends of each side panel to form an enclosed container. A back panel is hingeably connected to a top panel to form one side panel, and a bottom panel is hingeably connected to a front panel to form the other side panel. Each of the front, back, and bottom panels has opposing coupling ends. The interior surface of each end panel has a coupling track that receives the coupling ends of the front, back, and bottom panels. Each of the side panels may be unfolded to provide a table or work surface. Additionally, each of the side panels have retracting or folding legs attached to the interior surface of the side panel that may be extended or unfolded to support the table or work surface. A vehicle hitch coupling support is attached to the bottom of the container. However, this invention has not been designed for transporting real estate or other like signs.

Another example of a hitch-mounted apparatus is US Patent application 20080257925 to Brooks, which describes a ski rack with horizontal storage which may be removably affixed to a conventional trailer hitch on a vehicle. A front carrier is complimentary to the rear carrier, but remains substantially vertical. Skis or snow boards may be secured between the rear carrier and the front carrier. However, this invention has not been designed for transporting real estate or other like signs.

Another example of a hitch-mounted apparatus is US Patent application 20080128463 to Bryan, which describes a trailer hitch mounted combination bike rack and workout station.

The device can be used to store and carry up to three bicycles, and can also be used as a workout station for pull ups, dips, sit ups and other exercises. However, this invention has not been designed for transporting real estate or other like signs.

Another example of a hitch-mounted apparatus is US Patent application 20070164536 to McClellan describes a motorcycle towing device which includes a substantially vertical member and a substantially horizontal member being interconnected for supporting a motorcycle wheel. A draw bar is connected to at least one of the members for insertion into a receiver mounted on a vehicle. A projection mounted on the draw bar is movable outwardly beyond the given outer dimension of the draw bar for contacting the receiver. However, this invention has not been designed for transporting real estate or other like signs.

Another example of a hitch-mounted apparatus is US Patent application 20070057000 to Webster, which describes an apparatus for carrying snowboards or other recreational equipment at the outside rear of a vehicle. The carrier includes at least one pair of supports with two pairs of slots. Each pair of adjacent slots hold two snowboards inserted bottom-to-bottom into the slots. The at least one pair of supports are attached to a vertical member that is attached to a box member. The box member is adapted to be inserted into a standard hitch receiver. However, this invention has not been designed for transporting real estate or other like signs.

Another example of a hitch-mounted apparatus is US Patent 20060218835 to Chafin, which describes a mobile sign carrier for displaying a sign that mounts on a vehicle receiver hitch. The mobile sign carrier has a base, a vertical piece and two cross pieces that fold down to form a cross shape. Four sliding brackets are provided, each having permanently attached a square, flat piece, which sliding brackets are mounted one each on each of the cross pieces and one each on the first end and the second end of the vertical piece. The sliding brackets are positioned and secured by means of a fastener to accommodate signs of different sizes. The mobile sign carrier provides a securing device for use on a vehicle with a tailgate. Safety chains further secure the vertical piece to the trailer hitch. A strobe light and night reflective tape are provided. Even though this invention has been specifically designed for display type signs, it does not include a specifically designed basket, frame, and hitch assembly for transporting real estate or other like signs.

There are many generic and specialized carriers that can be mounted to a receiver hitch assembly on a car, SUV, van or truck.

None of these generic or specialized carriers, either individually or in combinations, describe a specific design or apparatus as provided in the present invention, that overcomes the problems real estate agents or brokers have relating to the transportation of real estate "for sale", "open house", and other like signs.

What is needed therefore, is a vehicle hitch assembly apparatus with an integrated sign carrier specifically related to real estate or other like signs, that is cost effective, easy to make, simple to use, and which solves these and other problems. This invention has as its primary objective fulfillment of this need.

FEATURES OF THE INVENTION

A general feature of the present invention is the provision of an apparatus for transporting signs, which overcomes the problems found in the prior art.

A further feature of the present invention is the provision of an apparatus configured for transporting signs for real estate or other like advertising.

A further feature of the present invention is the provision of an apparatus configured for transporting signs of various sizes and configurations for real estate or other like advertising.

A further feature of the present invention is the provision of an apparatus configured for transporting signs for political advertising.

A further feature of the present invention is the provision of a welded basket assembly configured for transporting signs.

A further feature of the present invention is the provision a bolted together basket assembly configured for transporting signs.

A further feature of the present invention is the provision of a molded basket configured for transporting signs.

A further feature of the present invention is the provision a welded basket assembly configured for transporting signs that is hinged and is capable of folding down for storage or shipping.

A further feature of the present invention is the provision a bolted together basket assembly configured for transporting signs that is hinged and is capable of folding down for storage or shipping.

A further feature of the present invention is the provision a welded basket assembly configured for transporting signs that is hinged and is capable of folding down for storage or shipping and is also hinged and is capable of folding up for storage in a vertical position while on a vehicle.

A further feature of the present invention is the provision a bolted together basket assembly configured for transporting signs that is hinged and is capable of folding down for storage or shipping and is also hinged and is capable of folding up for storage in a vertical position while on a vehicle.

A further feature of the present invention is the provision of a plate that can hold a magnetic advertising sign on the basket assembly.

A further feature of the present invention is the provision of a frame that can hold an advertising sign on the basket assembly.

A further feature of the present invention is the provision of a bracket that can hold an advertising sign on the basket assembly.

A further feature of the present invention is the provision of safety reflectors on the basket assembly.

A further feature of the present invention is the provision of night reflective tape on the basket assembly.

A further feature of the present invention is the optional provision of lights on the basket assembly.

A further feature of the present invention is the optional provision of a license plate frame on the basket assembly, which optionally can be lighted.

A further feature of the present invention is the optional provision for hinging the basket assembly frame to allow the basket assembly and frame to swing away from the vehicle around a vertical axis.

A further feature of the present invention is the optional provision for a receiver hitch-size adapter.

A further feature of the present invention is the provision of a hinged front basket gate that allows easy access to the signs stored in the basket.

A further feature of the present invention is the provision of a hinged side basket gate that allows easy access to the signs stored in the basket.

A further feature of the present invention is the provision of a solid or semi-solid basket inserts that make the open sided basket useful for transporting items other than signs.

A further feature of the present invention is the provision of a basket configured to transport signs vertically, right side up.

A further feature of the present invention is the provision of a basket configured to transport signs vertically, upside down.

A further feature of the present invention is the provision of a basket configured to transport signs horizontally.

A further feature of the present invention is the provision of a basket assembly largely constructed of steel.

A further feature of the present invention is the provision of a basket assembly largely constructed of aluminum.

A further feature of the present invention is the provision of a basket assembly largely constructed of stainless steel.

A further feature of the present invention is the provision of a basket assembly largely constructed of plastic.

A further feature of the present invention is the provision of a basket assembly that is painted.

A further feature of the present invention is the provision of a basket assembly that is plated.

A further feature of the present invention is the provision of a basket assembly that is anodized.

A further feature of the present invention is the provision of a basket assembly that is powder coated.

A further feature of the present invention is the provision of a basket assembly that is rubber coated.

A further feature of the present invention is the provision of an optional tool pouch that can be mounted and dismounted from the basket assembly.

A further feature of the present invention is the provision of an optional sign rider pouch that can be mounted and dismounted from the basket assembly.

A further feature of the present invention is the provision of an optional toolbox that can be mounted and dismounted from the basket assembly.

A further feature of the present invention is the provision of an optional flashing safety light on the basket assembly to make a parked vehicle more visible to passing motorists.

A further feature of the present invention is the provision of an optional GPS unit which can used for marking the location of signs that have been placed for real estate, political, or other advertising.

A further feature of the present invention is the provision of optional fold-down or drop down wheels mounted to the basket assembly for ease of mobility when the present invention is not mounted to a vehicle.

A further feature of the present invention is the provision of optional handles mounted to the basket assembly to aid in movement of the basket assembly to and from the vehicle.

A further feature of the present invention is the provision of a basket, frame, and hitch assembly for transporting signs on a vehicle that is lightweight.

A further feature of the present invention is the provision of a basket, frame, and hitch assembly for transporting signs on a vehicle that will increase convenience and efficiency for the person handling the signs.

A further feature of the present invention is the provision of a basket, frame, and hitch assembly for transporting signs on a vehicle that will help preserve the value of the vehicle it is attached to.

A further feature of the present invention is the provision of a basket, frame, and hitch assembly for transporting signs on a vehicle that will reduce the noise associated with signs rattling around inside a vehicle.

A further feature of the present invention is the provision of a basket, frame, and hitch assembly for transporting signs on a vehicle that will create public safety awareness when stopped on the street.

A further feature of the present invention is the provision of a basket, frame, and hitch assembly for transporting signs on a vehicle that will help to market or advertise the person using the signs.

A further feature of the present invention is the provision of a basket, frame, and hitch assembly for transporting signs on a vehicle that will prevent messes and look more professional.

A further feature of the present invention is the provision of a basket, frame, and hitch assembly for transporting signs on a vehicle that is cost effective.

A further feature of the present invention is the provision of a wall mounted receiver assembly for storing the basket, frame, and hitch assembly when not mounted to a vehicle receiver hitch.

A further feature of the present invention is the provision of a free standing receiver assembly for storing the basket, frame, and hitch assembly when not mounted to a vehicle receiver hitch.

One or more of these and/or other objects, features or advantages of the present invention will become apparent from the following specification and claims.

SUMMARY OF THE INVENTION

The present invention, also known as Sign Dock™, relates generally to an apparatus that is designed to be inserted into a vehicle receiver hitch assembly to transport signs. Furthermore, the present invention is specifically designed to transport real estate and other like signs.

The primary difference between the present invention and prior art is the present invention is specifically designed for transporting real estate and other like signs using a basket like assembly designed to be mounted to a vehicle receiver hitch assembly. The prior art previously discussed either describes generalized carriers that are not suitable for transporting real estate or other like signs, or describes hitch-mounted carriers designed for very specific items such as bicycles, skis, snowboards, powered wheel-chairs, even stanchions for displaying signs in a construction zone, but not carriers specifically designed for transporting real estate or other like signs using a basket like assembly designed to be mounted to a vehicle receiver hitch.

One embodiment of the present invention is a welded basket assembly that is not capable of folding down for shipping or storage.

A second embodiment of the present invention is a bolted together basket assembly that is not capable of folding down for shipping or storage.

A third embodiment of the present invention is a molded basket attached to a frame that is not capable of folding down for shipping or storage, but is capable of being disassembled for shipping.

A fourth embodiment of the present invention is a welded basket assembly that is hinged appropriately so the apparatus is capable of folding down for shipping or storage.

A fifth embodiment of the present invention is a bolted together basket assembly that is hinged appropriately so the apparatus is capable of folding down for shipping or storage.

A sixth embodiment of the present invention is a welded basket assembly that is hinged appropriately so the apparatus is capable of folding down for shipping or storage, and is also hinged appropriately to allow the folded down basket to rotate up into a vertical storage position while still mounted to the vehicle hitch assembly.

A seventh embodiment of the present invention is a bolted together basket assembly that is hinged appropriately so the apparatus is capable of folding down for shipping or storage, and is also hinged appropriately to allow the folded down basket to rotate up into a vertical storage position while still mounted to the vehicle hitch assembly.

All the embodiments of the present invention include specifically designed basket like assemblies for transporting real estate and other like signs. Also, all of the embodiments are designed to be capable of being mounted to and dismounted from a vehicle receiver type hitch assembly.

A more complete understanding of the apparatus for the transportation of real estate and other like signs in a basket and frame assembly designed for use in conjunction with a receiver hitch will be afforded to those skilled in the art, as well as a realization of the additional features, options, and advantages thereof, by a consideration of the following detailed description of the preferred embodiment. Reference will be made to the appended drawings which will first be described briefly.

DETAILED DESCRIPTION OF VARIOUS EMBODIMENTS

It should be noted the various embodiments of the present invention, also known as Sign Dock™, illustrated in FIGS. 1A through 7 have been shown using a minimum number of elements necessary to create an operable apparatus. It should also be noted that even though every conceivable configuration cannot be shown, various modifications, adaptations, and alternatives may be made to the present invention depending on the sign size, configuration, etc.

Figure 1A:
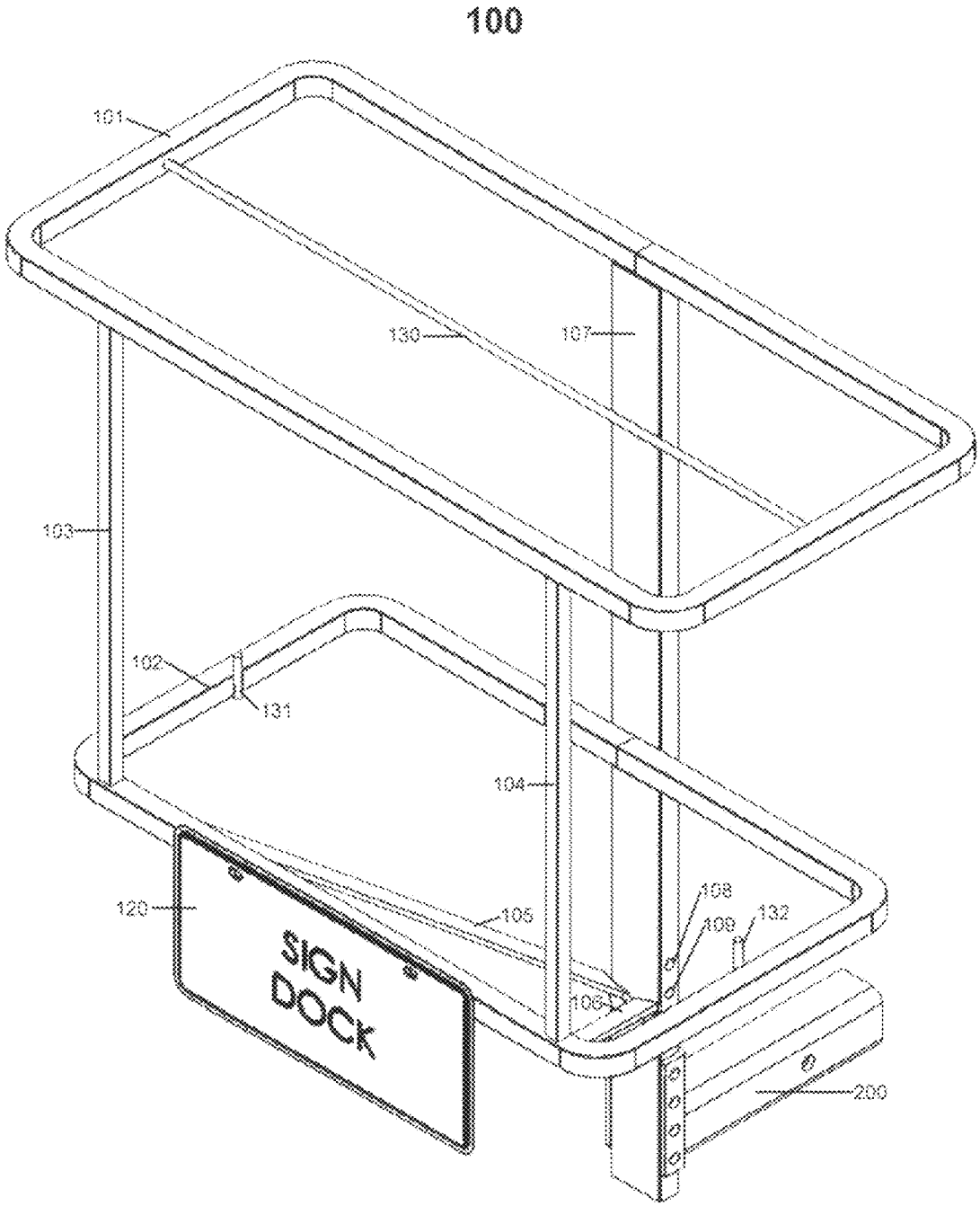
FIG. 1A is a graphic representation of the preferred embodiment of the present invention, which is a welded basket assembly with optional sign that is not capable of folding down for shipping or storage.

FIG. 1A is a graphic representation of the preferred embodiment of the present invention, which is a welded basket assembly 100 with optional sign 120, and a welded ball mount assembly 200. The welded basket assembly 100 is not capable of folding down for shipping or storage. The welded ball mount assembly 200 can be removed for shipping or storage purposes. The welded ball mount assembly 200 is further described in FIG. 1C. The welded basket assembly 100 of the preferred embodiment of the present invention includes the following structural members: upper loop 101, lower loop 102, vertical standoffs 103, 104, supports 105, 106, main upright 107. Two supports 105, 106 are illustrated; alternatively, fewer or more supports may be used. The welded basket assembly 100 also includes elements to control signs in the welded basket: divider 130, and stop pin 131, 132.

The welded basket assembly 100 is constructed as follows. Upper loop 101 and lower loop 102, which are shown as square cross-section tubing, are bent into a rectangular shape with rounded corners. Upper loop 101 is welded to the top of main upright 107, which is shown as rectangular cross-section tubing. Lower loop 102 is welded to the face of main upright 107. Upper loop 101 and lower loop 102 are connected together at the front of the welded basked assembly 100 by vertical standoffs 103, 104, which are shown as square cross-section tubing, and are welded to the lower horizontal surface of upper loop 101, and also welded to the upper horizontal surface of lower loop 102.

The welded basket assembly 100 is stabilized by supports 105, 106, which are welded to the lower surface of lower loop 102, and the vertical face of main upright 107. Supports 105, 106 are left-right mirror image parts. The resulting triangular space frame gives tremendous strength to the welded basket assembly 100 for vertical loading, cantilevered loading, and anti-torsion for the "upper loop 101, lower loop 102, vertical standoff 103, 104, and main upright 107 sub-assembly" of welded basket assembly 100. Support 105, 106 are further described in FIG. 1B.

Welded basket assembly 100 includes three elements, which are used to control signs placed in the welded basket. These elements, which are used to control excessive rocking and sliding of signs in the welded basket assembly 100, include divider 130, which is shown as a circular cross-section tube, which is welded to the inside vertical faces of upper loop 101. The other control elements are stop pins 131, 132, which are shown as circular cross-section bars, which are welded to the inside vertical faces of lower loop 102.

Main upright 107 includes holes 108, 109 near the bottom of the structural member. The holes 108, 109 are drilled, punched, laser cut, water jet cut, etc, through the shorter vertical faces of main upright 107, and are illustrated centered on the vertical axis of the short face of main upright 107. The holes 108, 109 are oriented parallel to the longest axis of the of the rectangular cross-section The holes 108, 109 are separated vertically by equal center-of-hole to center-of-hole dimensions. The preferred embodiment as illustrated shows eight holes. Four are aligned with welded ball mount assembly 200, two are hidden behind lower loop 102, and two additional holes 108, 109 are shown in main upright 107. Any four consecutive holes in the main upright 107 are lined up with the four holes in the welded ball mount assembly 200 to connect the two assemblies together. Although, four holes are shown lining up on the two assemblies 100 and 200, at least two bolts or pins are required to keep the entire assembly 100 and 200 from rotating with respect to one another. The extra holes in main upright 107 allow for welded basket assembly 100 to be mounted at a height off the ground that is appropriate for any type vehicle with a receiver hitch, such as, but not limited to, a sedan, SUV, van, truck, etc.

The welded basket assembly 100 also includes provision for an optional sign 120 to be attached. Optional sign 120 is illustrated as having the same dimensions of a standard vehicle license plate. If a license plate is required, two holes (not shown) in lower loop 102 can be used to attach a license plate the size of optional sign 120, or an optional sign 120, to lower loop 102. The holes (not shown), which extend through the front and rear faces of lower loop 120 can be tapped, or untapped, and a screw, bolt, or bolt and nut, can be used to attach the optional sign 120, which may also be a license plate.

Welded basket assembly 100 can be designed appropriately to carry signs in any, or all, of the following orientations: 1) right-side up, 2) upside-down, or 3) turned 90 degrees on one of the sides.

Welded basket assembly can be used for transporting and containing signs such as, but not limited to, real estate signs, political signs, etc.

It is important to note that any of the horizontal or vertical joints in the welded basket assembly 100 can be gusseted to provide additional strength and rigidity. The gussets may be welded or bolted.

In addition to the cross-sections described in FIG. 1A for various structural members of basket assembly 100, they can also be chosen from the set of standard structural shapes consisting of, but not limited to, angle, square tube, round tube, channel, round bar, square bar, etc.

The structural members can of welded basket assembly 100 can be from the set of materials consisting of, but not limited to, carbon steel, alloy steel, stainless steel, aluminum, etc.

Welded ball mount assembly 200 includes a hole that is aligned with a hole in a vehicle receiver hitch (not shown) in order for a hitch pin to be inserted to connect the basket and hitch assembly 100 of the present invention to a receiver hitch on a vehicle (not shown).

In addition, the entire assembly as shown in FIG. 1A can be designed to be bolted together.

Furthermore, the assembly as shown in FIG. 1A can be designed to be partially welded, and partially bolted together.

Another option of the present invention as illustrated in FIG. 1A is the provision of safety reflectors or reflective tape. A reflector, which is sometimes called a "retro reflector", is a product that actually reflects light from a source back. The light source can be headlights, a flashlight or the like. The reflector can be a hard plastic part, a sheet of reflective material, or soft vinyl reflective film fabricated into an unlimited variety of shapes. There are prismatic reflectors and glass bead reflectors, but both reflect light sufficiently to make the wearer visible in the dark up to 500 feet away from the light source, or more.

Another option of the present invention as illustrated in FIG. 1A is the provision of lights.

Another option of the present invention as illustrated in FIG. 1A is the provision for a receiver hitch-size adapter to adapt the receiver hitch size from 2" to 1-¼" or from 1-¼" to 2".

Another option of the present invention as illustrated in FIG. 1A is the provision for a finish such as, but not limited to, unfinished, painting, plating, powder coating, rubber coating, etc.

Another option of the present invention as illustrated in FIG. 1A is the provision of a tool pouch that can be mounted and dismounted from the basket and hitch assembly.

Another option of the present invention as illustrated in FIG. 1A is the provision of a sign rider pouch that can be mounted and dismounted from the basket and hitch assembly.

Another option of the present invention as illustrated in FIG. 1A is the provision of a toolbox that can be mounted to the basket and hitch assembly.

Another option of the present invention as illustrated in FIG. 1A is the provision of fold-down or drop down wheels mounted to the basket assembly for ease of mobility when the present invention is not mounted to a vehicle.

Another option of the present invention as illustrated in FIG. 1A is the provision of handles mounted to the basket assembly to aid in movement of the basket assembly to and from the vehicle (not shown).

Figure 1B:
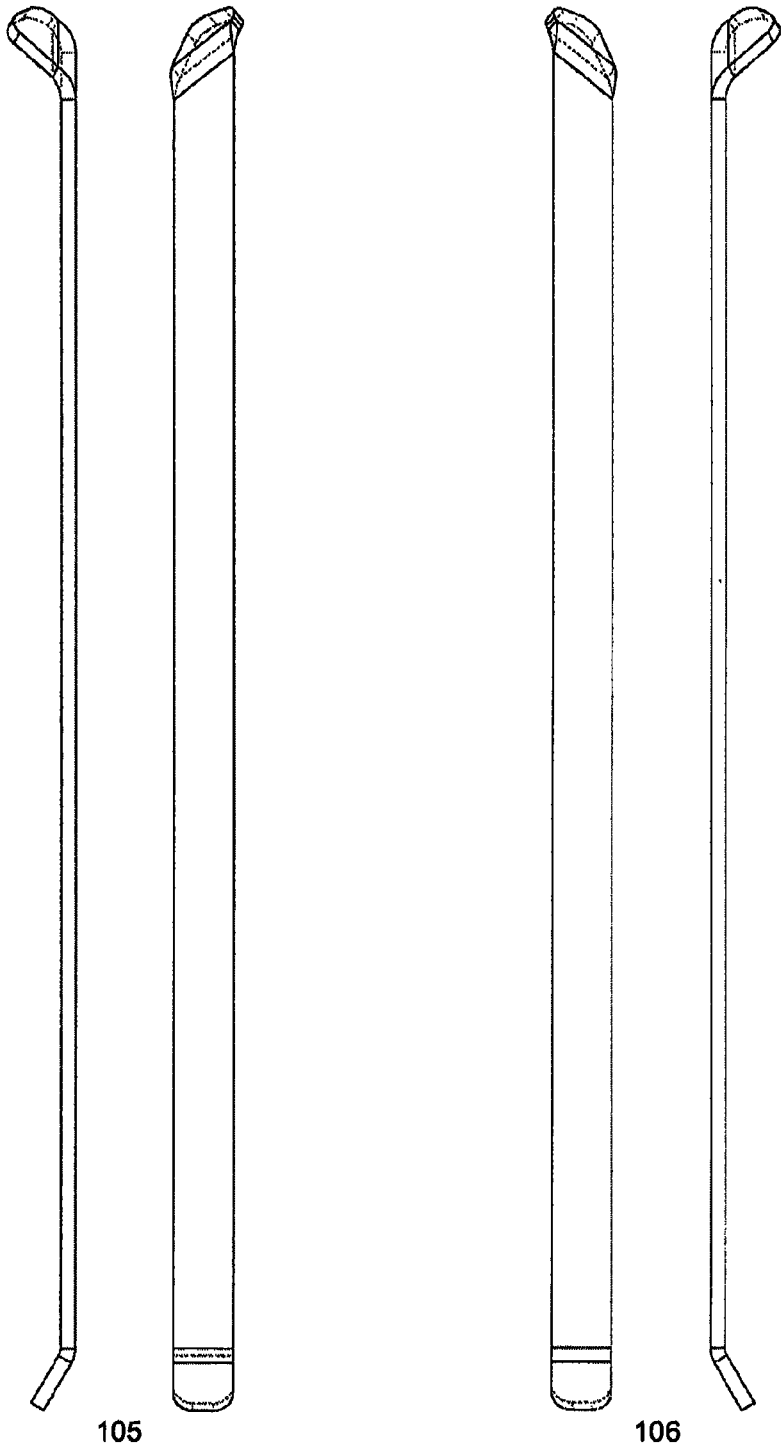
FIG. 1B is a graphic representation of the details of the structural support members used to strengthen the welded basket assembly described in FIG. 1A.

FIG. 1B is a graphic representation of the details of supports 105, 106 used to strengthen the welded basket assembly described in FIG. 1A.

Support 105, 106, which are left-right mirror image parts, are shown in FIG. 1B as rectangular cross-section bar, which has been radiused at either end, and bent appropriately at each end to accommodate being welded to the vertical face of main upright 107, and also being welded to the bottom horizontal surface of lower loop 102.

Figure 1C:
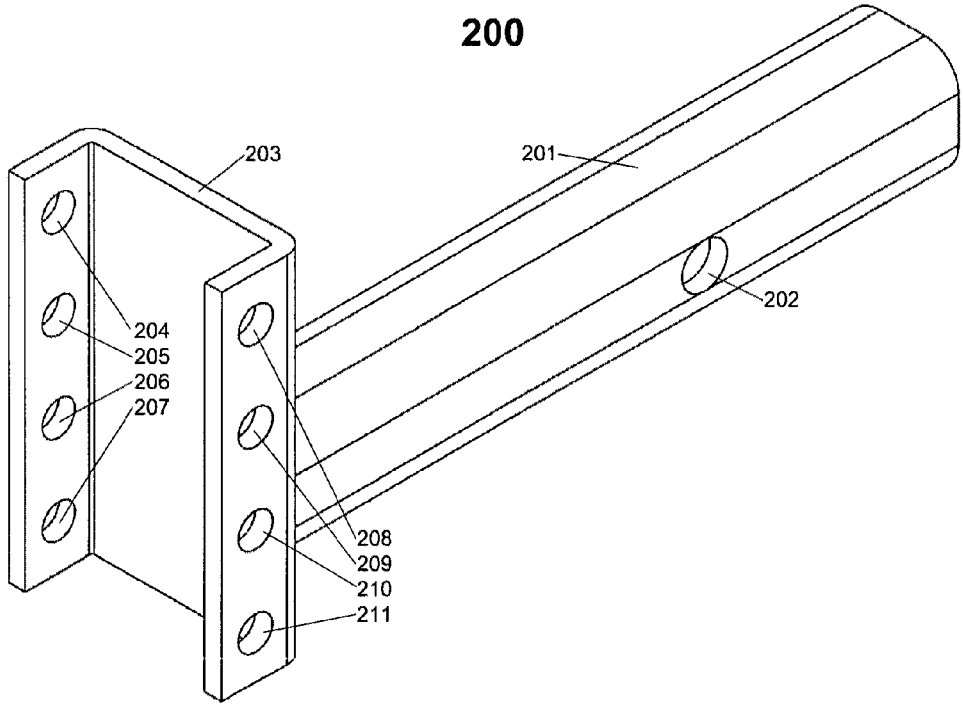
FIG. 1C is a graphic representation of the details of the welded ball mount assembly used to attached the welded basket assembly described in FIG. 1A to a receiver hitch (not shown).

FIG. 1C is a graphic representation of the details of the welded ball mount assembly 200 used to attached the welded basket assembly 100 described in FIG. 1A to a receiver hitch (not shown). The receiver hitch can be mounted to a vehicle, or a wall mount receiver hitch 800 as described in FIG. 8, or a free standing receiver hitch 900 as described in FIG. 9.

Welded ball mount assembly 200 consists of two structural members, receiver tube 201, and adjustment channel 203. Receiver tube 201 is designed to fit tightly into the receiver stub of a standard receiver hitch (not shown). Receiver tube 201 also includes a through hole 202 that penetrates the vertical faces of receiver tube 201. Through hole 202 is sized appropriately to line-up with a similar hole in the stub of a standard receiver hitch (not shown), for the purpose of mating and securing welded ball mount assembly 200 to the receiver stub of a standard receiver hitch (not shown), which furthermore is attached to a receiver hitch (not shown), which even furthermore is attached to a vehicle (not shown), or a wall mount receiver hitch 800 as described in FIG. 8, or a free standing receiver hitch 900 as described in FIG. 9.

Receiver tube 201 is welded to adjustment channel 203. Adjustment channel 203 is sized appropriately to fit tightly to the outside x and y dimensions of main upright 107, which is shown in FIG. 1A. Adjustment channel 203 includes eight holes 204, 205, 206, 207, 208. 209, 210, 211, of which four 204, 205, 206, 207 are located on one of the short dimension sides of the structural member that makes up adjustment channel 203, and are dia-metrically opposed to holes 208, 209, 210, 211, located on the other short dimension side of the structural member that makes up adjustment channel 203. The holes 204, 205, 206, 207 and 208, 209, 210, 211 are located vertically equi-distant center-of hole to next center-of-hole Holes 204, 205, 206, 207, 208. 209, 210, 211, and are designed to line-up with similar holes in main upright 107 (not shown). The extra holes in main upright 107 (not shown) are used to provide vertical adjustability of the entire welded basket assembly 100 with respect to the ground. Furthermore, holes 204, 205, 206, 207, 208, 209, 210, 211 are used to bolt or pin the welded ball mount assembly 200 to welded basket assembly 100 together.

It is important to note that any of the horizontal or vertical joints in the welded ball mount basket assembly 200 can be gusseted to provide additional strength and rigidity. The gussets may be welded or bolted.

The structural members can of welded ball mount assembly 200 can be from the set of materials consisting of, but not limited to, carbon steel, alloy steel, stainless steel, aluminum, etc.

Another option of the welded ball mount assembly 200 as illustrated in FIG. 1C is the provision for a finish such as, but not limited to, unfinished, painting, plating, powder coating, rubber coating, etc.

Figure 2:
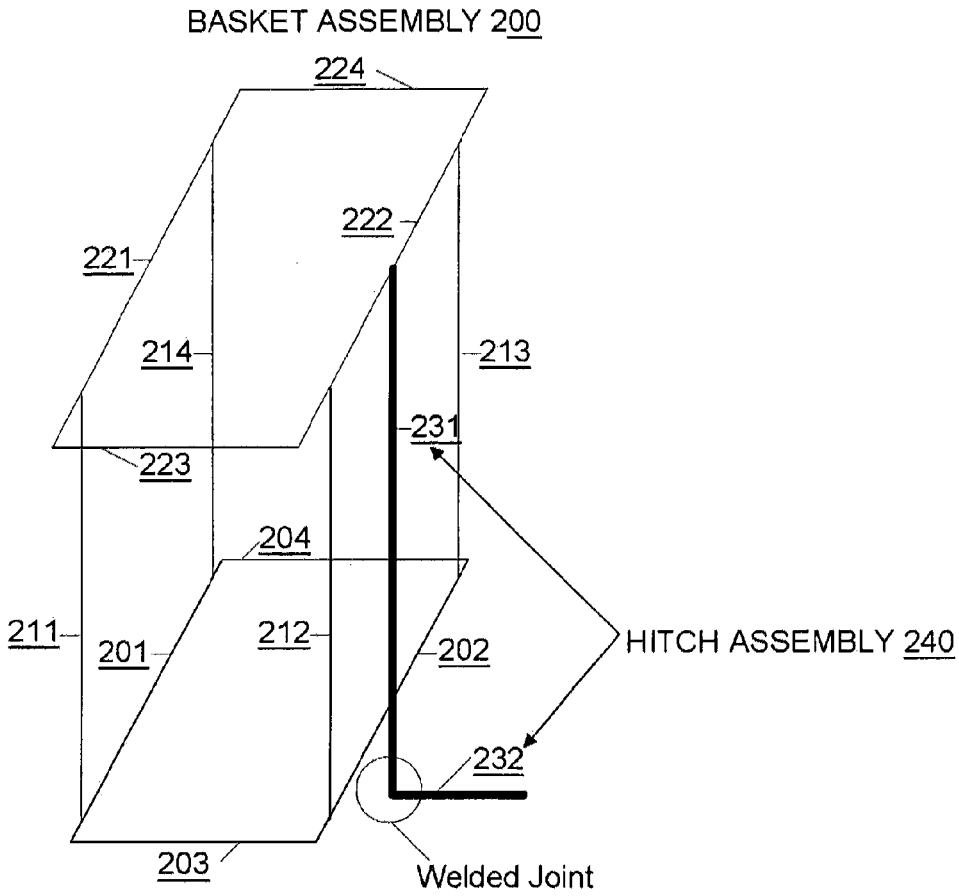
FIG. 2 is a graphic representation of a second embodiment of the present invention, which is a bolted together basket assembly that is generally capable of folding down for shipping or storage, but is also capable of being disassembled for shipping.

FIG. 2 is a graphic representation of a second embodiment of the present invention, which is a bolted together basket assembly that is designed generally to be capable of folding down for shipping or storage, and is capable of being disassembled for shipping. This basket and hitch assembly 250 of this embodiment is constructed as follows. The frame that comprises the bottom of the basket assembly 200 is constructed of two longitudinal structural members 201, 202 and two transverse structural members 203, 204. The longitudinal structural members 201, 202 and transverse structural members 203, 204 are bolted together to generally form a rectangular or square shape. The longitudinal and transverse structural members 201, 202, 203, 204 that form the bottom of the basket assembly 200 can be chosen from the set of standard structural shapes consisting of, but not limited to, angle, square tube, round tube, channel, etc. In addition, the longitudinal and transverse structural members 201, 202, 203, 204 that form the bottom of the basket assembly 200 can be chosen from the set of materials consisting of, but not limited to, carbon steel, alloy steel, stainless steel, aluminum, etc. The frame that comprises the bottom of the basket assembly 200 is designed such that signs that are to be carried in the present invention will be appropriately supported for transport. The bottom frame of basket assembly 200 can be designed appropriately to carry signs in any, or all, of the following orientations: 1) right-side up, 2) upside-down, or 3) turned 90 degrees on one of the sides.

Furthermore, the basket assembly 200 is constructed of vertical structural members 211, 212, 213, 214 that are bolted to the frame members that comprise the bottom of basket assembly 200 previously described, and to the frame members that comprise the top of basket assembly 200, which is described below. The vertical structural members 211, 212, 213, 214 can be chosen from the set of standard structural shapes consisting of, but not limited to angle, square tube, round tube, channel, etc. In addition, the vertical structural members 211, 212, 213, 214 that form the vertical portion of the basket assembly 200 can be chosen from the set of materials consisting of, but not limited to, carbon steel, alloy steel, stainless steel, aluminum, etc. The vertical structural members 211, 212, 213, 214 of basket assembly 200 are designed and placed such that signs that are to be carried in the present invention will be appropriately contained during transport. The vertical structural members 211, 212, 213, 214 can be designed appropriately to carry signs in any, or all, of the following orientations: 1) right-side up, 2) upside-down, or 3) turned 90 degrees on one of the sides.

Furthermore, the frame that comprises the top of basket assembly 200 is constructed of two longitudinal structural members 221, 222 and two transverse structural members 223, 224. The longitudinal structural members 221, 222 and transverse structural members 223, 224 are bolted together to generally form a rectangular or square shape. The longitudinal and transverse structural members 221, 222, 223, 224 that form the top of basket assembly 200 can be chosen from the set of standard structural shapes consisting of, but not limited to, angle, square tube, round tube, channel, etc. In addition, the longitudinal and transverse structural members 221, 222, 223, 224 that form the top of basket assembly 200 can be chosen from the set of materials consisting of, but not limited to, carbon steel, alloy steel, stainless steel, aluminum, etc. The frame that comprises the top of basket assembly 200 is designed such that signs that are to be carried in the present invention will be appropriately contained for transport. The frame can be designed appropriately to contain signs being transported in any, or all, of the following orientations: 1) right-side up, 2) upside-down, or 3) turned 90 degrees on one of the sides. The frame that comprises the top of basket assembly 200 is bolted to the vertical structural members 211, 212, 213, 214, which are in turn bolted to the frame that comprise the bottom of basket assembly 200 previously described, to form the entire basket assembly 200 used in the present invention for transporting and containing real estate and other like signs.

It is important to note that any of the horizontal or vertical joints in basket assembly 200 can be gusseted to provide additional strength and rigidity.

Basket assembly 200 is bolted to hitch assembly 240 to form basket and hitch assembly 250. Hitch assembly 240 is constructed of structural members 231, 232. Vertical structural member 231 is welded to horizontal structural member 232 to form hitch assembly 240. The vertical structural member 231 of hitch assembly 240 is bolted to basket assembly 200 on at least two structural members. Vertical and horizontal structural members 231, 232 of hitch assembly 240 can be chosen from the set of standard structural shapes consisting of, but not limited to, angle, square tube, round tube, channel, etc.

In addition, the vertical and horizontal structural members 231, 232 of hitch assembly 240 can be from the set of materials consisting of, but not limited to, carbon steel, alloy steel, stainless steel, aluminum, etc. Horizontal structural member 232 includes a hole that is aligned with a hole in a vehicle receiver hitch (not shown), or a wall mount receiver hitch 800 as described in FIG. 8, or a free standing receiver hitch 900 as described in FIG. 9, in order for a hitch pin to be inserted to connect the basket and hitch assembly 250 of the present invention to a receiver hitch on a vehicle, or a wall mount receiver hitch 800 as described in FIG. 8, or a free standing receiver hitch 900 as described in FIG. 9.

The bolted connections in FIG. 2 can be constructed as described in FIG. 6 and FIG. 7 as follows.

Figure 6:
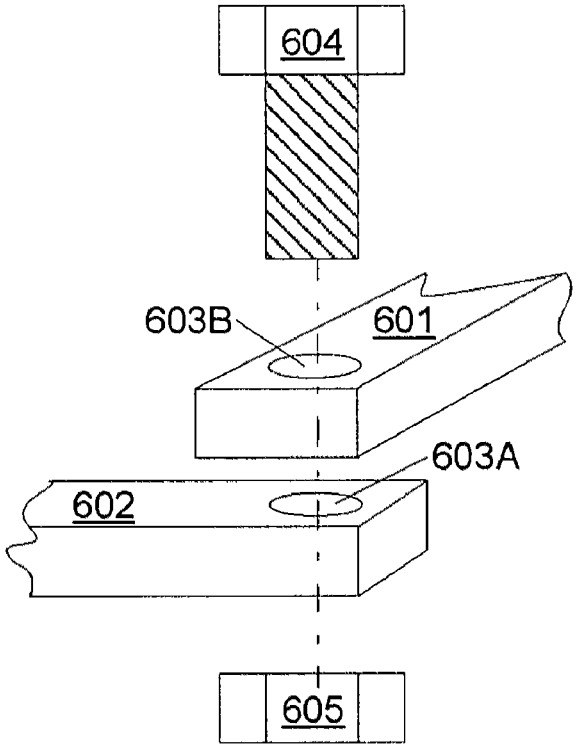
FIG. 6 is an exploded diagram that describes how structural members are bolted together vertically.

FIG. 6 is an exploded diagram that describes how structural members are bolted together vertically. The vertically oriented connection for the longitudinal and transverse structural members 601, 602 that intersect for the purpose of making a bolted connection can be chosen from the set of standard structural shapes consisting of, but not limited to, angle, square tube, round tube, channel, etc. In addition, the material for structural members 601, 602 can be chosen from the set consisting of, but not limited to, carbon steel, alloy steel, stainless steel, aluminum, etc. Longitudinal and transverse structural members 601, 602 have holes 603A, 603B. Holes 603A, 603B may be drilled, punched or cut into the longitudinal and transverse structural members 601, 602. Holes 603A, 603B are aligned during assembly in order to allow bolt 604 to be inserted through the holes 603A, 603B and tightened appropriately with nut 605 to form a bolted connection. An optional lock washer (not shown) may be used with bolt 604 and nut 605 in order to bolt the structural members together.

Figure 7:
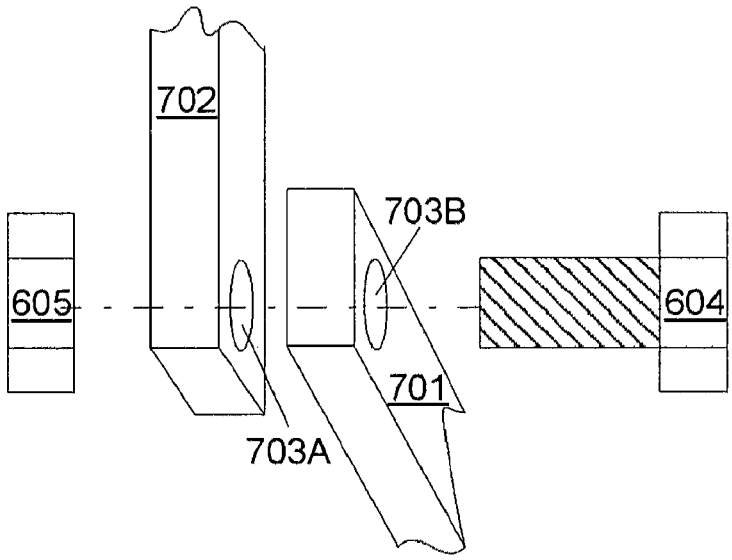
FIG. 7 is an exploded diagram that describes how structural members are bolted together horizontally.

FIG. 7 is an exploded diagram that describes how structural members are bolted together horizontally. The horizontally oriented connection for the longitudinal and vertically oriented transverse structural members 701, 702 in this example, intersect for the purpose of making a bolted connection, and can be chosen from the set of standard structural shapes consisting of, but not limited to, angle, square tube, round tube, channel, etc). In addition, the material for structural members 701, 702 can be chosen from the set consisting of, but not limited to, carbon steel, alloy steel, stainless steel, aluminum, etc. Longitudinal and transverse structural members 701, 702 have holes 703A, 703B. Holes 703A, 703B may be drilled, punched or cut into the horizontally oriented longitudinal and vertically oriented transverse structural members 701, 702. Holes 703A, 703B are aligned during assembly in order to allow bolt 604 to be inserted through the holes 703A, 703B and nut 605 tightened appropriately to form a bolted connection. An optional lock washer (not shown) may be used with bolt 604 and nut 605 in order to bolt the structural members together.

Figure 3:
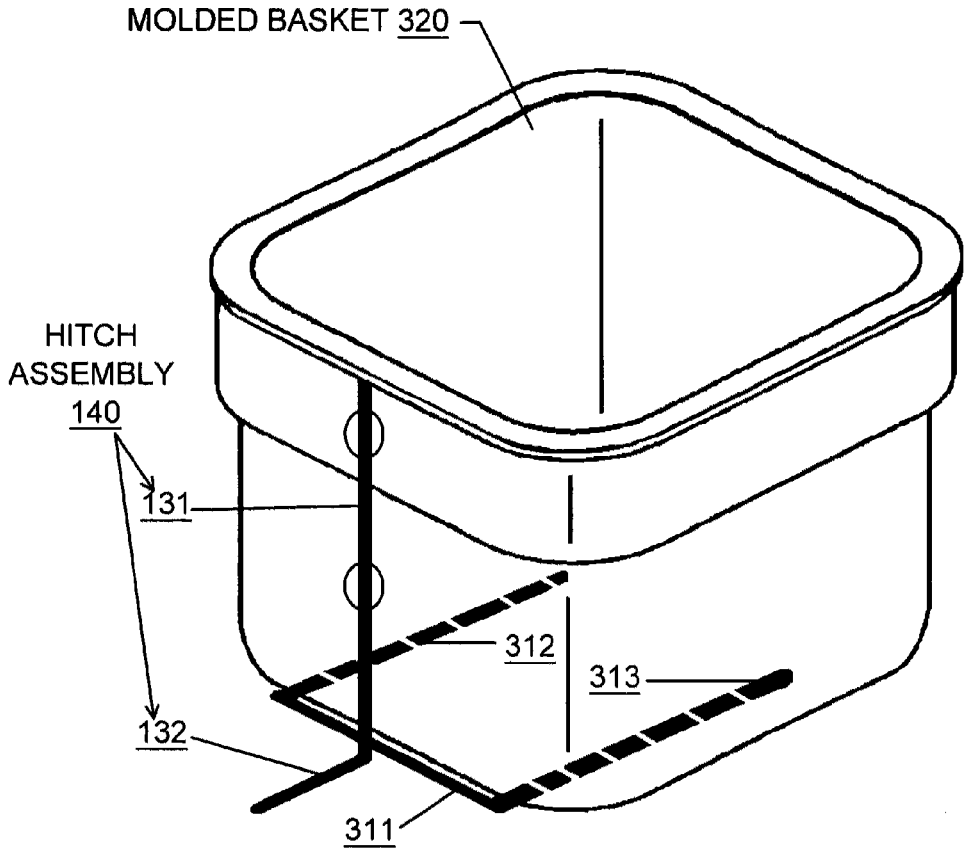
FIG. 3 is a graphic representation of a third embodiment of the present invention, which is a molded basket attached to a frame that is not capable of folding down for shipping or storage.

FIG. 3 is a graphic representation of a third embodiment of the present invention, which is a molded basket attached to a frame that is not capable of folding-down for shipping or storage. This basket and hitch assembly 300 of this embodiment is constructed as follows. The frame that comprises the support for molded basket 320 is constructed of one longitudinal structural member 311 and two transverse structural members 312, 313. The longitudinal structural member 311 and transverse structural members 312, 313 are welded together to generally form an open-ended rectangular or square shape. The longitudinal and transverse structural members 311, 312, 313 that form the frame that supports the molded basket 320 can be chosen from the set of standard structural shapes consisting of, but not limited to, angle, square tube, round tube, channel, etc. In addition, the longitudinal and transverse structural members 311, 312, 313 that form the frame that supports the molded basket assembly 320 can be chosen from the set of materials consisting of, but not limited to, carbon steel, alloy steel, stainless steel, aluminum, etc.

It is important to note that any of the structural joints in this embodiment of the present invention can be gusseted to provide additional strength and rigidity. The gussets may be welded or bolted.

Molded basket 320 is bolted to hitch assembly 140 to form a molded basket and hitch assembly 300. The molded basket 320 can be made from the set of materials consisting of, but not limited to, polypropylene (PP), polystyrene (PS), polyvinyl chloride (PVC), polyamide (PA) also known as Nylon, synthetic rubber, etc. Hitch assembly 140 is constructed of structural members 131, 132. Vertical structural member 131 is welded to horizontal structural member 132 to form hitch assembly 140. The vertical structural member 131 of hitch assembly 140 is attached to longitudinal structural member 311 and to molded basket 320 on at least two points. Vertical and horizontal structural members 131, 132 of hitch assembly 140 can be chosen from the set of standard structural shapes consisting of, but not limited to, angle, square tube, round tube, channel, etc.

In addition, the vertical and horizontal structural members 131, 132 of hitch assembly 140 can be from the set of materials consisting of, but not limited to, carbon steel, alloy steel, stainless steel, aluminum, etc. Horizontal structural member 132 includes a hole that is aligned with a hole in a vehicle receiver hitch (not shown), or a wall mount receiver hitch 800 as described in FIG. 8, in order for a hitch pin to be inserted to connect the molded basket and hitch assembly 300 of the present invention to a receiver hitch on a vehicle, or a wall mount receiver hitch 800 as described in FIG. 8, or a free standing receiver hitch 900 as described in FIG. 9.

It is important to note that any of the horizontal or vertical joints in hitch assembly 140 can be gusseted to provide additional strength and rigidity.

Figure 4:
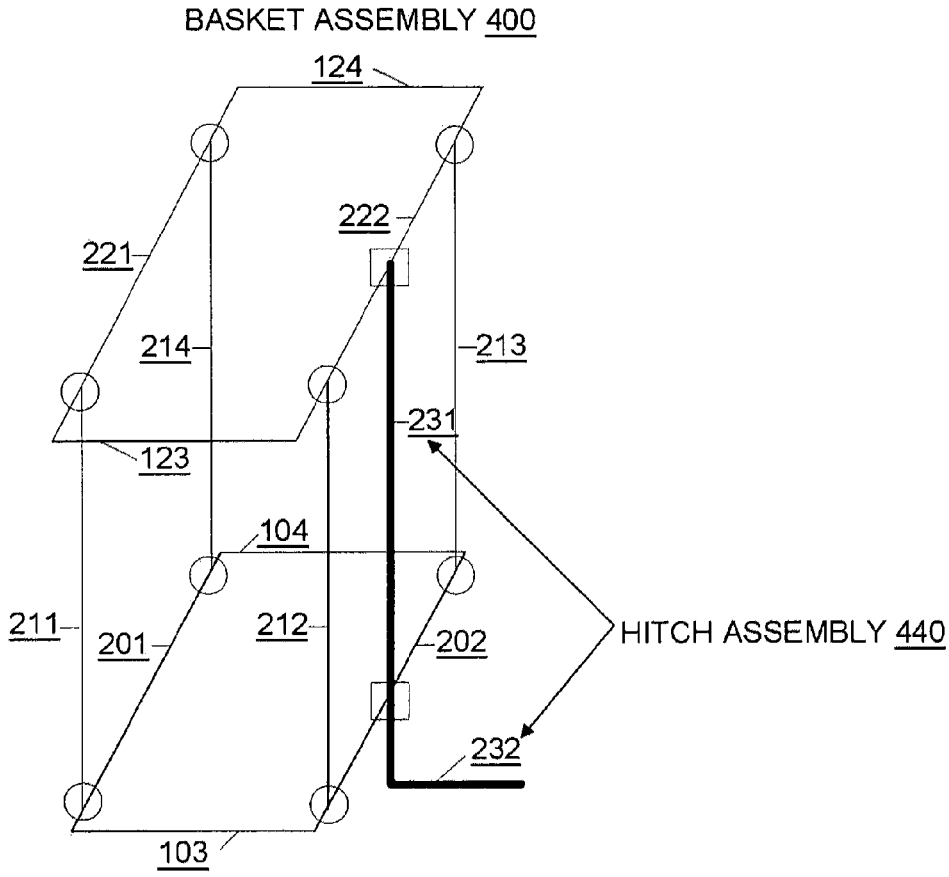
FIG. 4 is a graphic representation of a fourth embodiment of the present invention, which is a welded basket assembly that is hinged appropriately so the apparatus is capable of folding down for shipping or storage.

FIG. 4 is a graphic representation of a fourth embodiment of the present invention, which is a welded basket assembly that is hinged appropriately so the apparatus is capable of folding down for shipping or storage. Welded and hinged joints are identified on the drawing. A hinged joint can rotate around a bolt and nut combination, a rivet, a pin, etc. This basket and hitch assembly 450 of this embodiment is constructed as follows. The frame that comprises the bottom of the basket assembly 400 is constructed of two longitudinal structural members 201, 202 and two transverse structural members 103, 104. The longitudinal structural members 201, 202 and transverse structural members 103, 104 are welded together to generally form a rectangular or square shape. The longitudinal and transverse structural members 201, 202, 103, 104 that form the bottom of the basket assembly 400 can be chosen from the set of standard structural shapes consisting of, but not limited to, angle, square tube, round tube, channel, etc. In addition, the longitudinal and transverse structural members 201, 202, 103, 104 that form the bottom of the basket assembly 400 can be chosen from the set of materials consisting of, but not limited to, carbon steel, alloy steel, stainless steel, aluminum, etc. The frame that comprises the bottom of the basket assembly 400 is designed such that signs that are to be carried in the present invention will be appropriately supported for transport. The bottom frame of basket assembly 400 can be designed appropriately to carry signs in any, or all, of the following orientations: 1) right-side up, 2) upside-down, or 3) turned 90 degrees on one of the sides.

Furthermore, the basket assembly 400 is constructed of vertical structural members 211, 212, 213, 214 that are welded to the frame members that comprise the bottom of basket assembly 400 previously described, and to the frame members that comprise the top of basket assembly 400, which is described below. The vertical structural members 211, 212, 213, 214 can be chosen from the set of standard structural shapes consisting of, but not limited to angle, square tube, round tube, channel, etc. In addition, the vertical structural members 211, 212, 213, 214 that form the vertical portion of the basket assembly 400 can be chosen from the set of materials consisting of, but not limited to, carbon steel, alloy steel, stainless steel, aluminum, etc. The vertical structural members 211, 212, 213, 214 of basket assembly 400 are designed and placed such that signs that are to be carried in the present invention will be appropriately contained during transport. The vertical structural members 211, 212, 213, 214 can be designed appropriately to carry signs in any, or all, of the following orientations: 1) right-side up, 2) upside-down, or 3) turned 90 degrees on one of the sides.

Furthermore, the frame that comprises the top of basket assembly 400 is constructed of two longitudinal structural members 221, 222 and two transverse structural members 123, 124. The longitudinal structural members 221, 222 and transverse structural members 123, 124 are welded together to generally form a rectangular or square shape. The longitudinal and transverse structural members 221, 222, 123, 124 that form the top of basket assembly 400 can be chosen from the set of standard structural shapes consisting of, but not limited to, angle, square tube, round tube, channel, etc. In addition, the longitudinal and transverse structural members 221, 222, 123, 124 that form the top of basket assembly 400 can be chosen from the set of materials consisting of, but not limited to, carbon steel, alloy steel, stainless steel, aluminum, etc. The frame that comprises the top of basket assembly 400 is designed such that signs that are to be carried in the present invention will be appropriately contained for transport. The frame can be designed appropriately to contain signs being transported in any, or all, of the following orientations: 1) right-side up, 2) upside-down, or 3) turned 90 degrees on one of the sides. The frame that comprises the top of basket assembly 400 is hinged appropriately to the vertical structural members 211, 212, 213, 214, which are in turn hinged appropriately to the frame that comprise the bottom of basket assembly 400 previously described, to form the entire basket assembly 400 used in the present invention for transporting and containing real estate and other like signs.

It is important to note that any of the horizontal or vertical joints in basket assembly 400 can be gusseted to provide additional strength and rigidity.

Basket assembly 400 is pinned or bolted to hitch assembly 440 to form basket and hitch assembly 450. Hitch assembly 440 is constructed of structural members 231, 232. Vertical structural member 231 is welded to horizontal structural member 232 to form hitch assembly 440. The vertical structural member 231 of hitch assembly 440 is pinned to basket assembly 400 on at least two structural members. Vertical and horizontal structural members 231, 232 of hitch assembly 440 can be chosen from the set of standard structural shapes consisting of, but not limited to, angle, square tube, round tube, channel, etc. In addition, the vertical and horizontal structural members 231, 232 of hitch assembly 440 can be from the set of materials consisting of, but not limited to, carbon steel, alloy steel, stainless steel, aluminum, etc. Horizontal structural member 232 includes a hole that is aligned with a hole in a vehicle receiver hitch (not shown), or a wall mount receiver hitch 800 as described in FIG. 8, or a free standing receiver hitch 900 as described in FIG. 9, in order for a hitch pin to be inserted to connect the basket and hitch assembly 450 of the present invention to a receiver hitch on a vehicle, or a wall mount receiver hitch 800 as described in FIG. 8, or a free standing receiver hitch 900 as described in FIG. 9.

It is important to note that any of the horizontal or vertical joints in present invention can be gusseted to provide additional strength and rigidity. The gussets may be welded or bolted.

Figure 5:
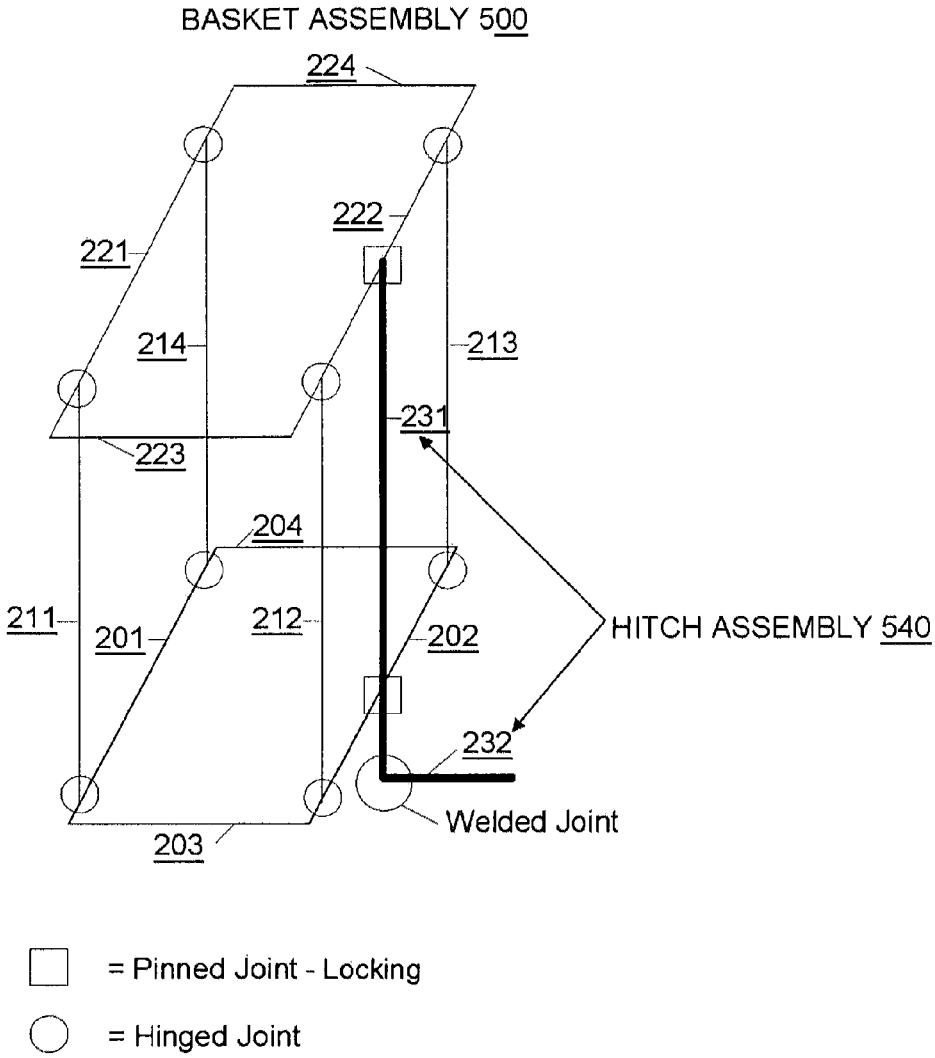
FIG. 5 is a graphic representation of a fifth embodiment of the present invention, which is a bolted together basket assembly that is hinged appropriately so the apparatus is capable of folding down for shipping or storage.

FIG. 5 is a graphic representation of a fifth embodiment of the present invention, which is a bolted together basket assembly that is hinged appropriately so the apparatus is capable of folding down for shipping or storage. Bolted and hinged joints are identified on the drawing. A hinged joint can rotate around a bolt and nut combination, a rivet, a pin, etc. This basket and hitch assembly 550 of this embodiment is constructed as follows. The frame that comprises the bottom of the basket assembly 500 is constructed of two longitudinal structural members 201, 202 and two transverse structural members 203, 204. The longitudinal structural members 201, 202 and transverse structural members 203, 204 are bolted together to generally form a rectangular or square shape. The longitudinal and transverse structural members 201, 202, 203, 204 that form the bottom of the basket assembly 500 can be chosen from the set of standard structural shapes consisting of, but not limited to, angle, square tube, round tube, channel, etc. In addition, the longitudinal and transverse structural members 201, 202, 203, 204 that form the bottom of the basket assembly 500 can be chosen from the set of materials consisting of, but not limited to, carbon steel, alloy steel, stainless steel, aluminum, etc. The frame that comprises the bottom of the basket assembly 500 is designed such that signs that are to be carried in the present invention will be appropriately supported for transport. The bottom frame of basket assembly 500 can be designed appropriately to carry signs in any, or all, of the following orientations: 1) right-side up, 2) upside-down, or 3) turned 90 degrees on one of the sides.

Furthermore, the basket assembly 500 is constructed of vertical structural members 211, 212, 213, 214 that are bolted to the frame members that comprise the bottom of basket assembly 500 previously described, and to the frame members that comprise the top of basket assembly 500, which is described below. The vertical structural members 211, 212, 213, 214 can be chosen from the set of standard structural shapes consisting of, but not limited to angle, square tube, round tube, channel, etc. In addition, the vertical structural members 211, 212, 213, 214 that form the vertical portion of the basket assembly 500 can be chosen from the set of materials consisting of, but not limited to, carbon steel, alloy steel, stainless steel, aluminum, etc. The vertical structural members 211, 212, 213, 214 of basket assembly 500 are designed and placed such that signs that are to be carried in the present invention will be appropriately contained during transport. The vertical structural members 211, 212, 213, 214 can be designed appropriately to carry signs in any, or all, of the following orientations: 1) right-side up, 2) upside-down, or 3) turned 90 degrees on one of the sides.

Furthermore, the frame that comprises the top of basket assembly 500 is constructed of two longitudinal structural members 221, 222 and two transverse structural members 223, 224. The longitudinal structural members 221, 222 and transverse structural members 223, 224 are bolted together to generally form a rectangular or square shape. The longitudinal and transverse structural members 221, 222, 223, 224 that form the top of basket assembly 500 can be chosen from the set of standard structural shapes consisting of, but not limited to, angle, square tube, round tube, channel, etc. In addition, the longitudinal and transverse structural members 221, 222, 223, 224 that form the top of basket assembly 500 can be chosen from the set of materials consisting of, but not limited to, carbon steel, alloy steel, stainless steel, aluminum, etc. The frame that comprises the top of basket assembly 500 is designed such that signs that are to be carried in the present invention will be appropriately contained for transport. The frame can be designed appropriately to contain signs being transported in any, or all, of the following orientations: 1) right-side up, 2) upside-down, or 3) turned 90 degrees on one of the sides. The frame that comprises the top of basket assembly 500 is bolted to the vertical structural members 211, 212, 213, 214, which are in turn bolted to the frame that comprise the bottom of basket assembly 500 previously described, to form the entire basket assembly 500 used in the present invention for transporting and containing real estate and other like signs.

It is important to note that any of the horizontal or vertical joints in present invention can be gusseted to provide additional strength and rigidity. The gussets may be welded or bolted.

Basket assembly 500 is pinned or bolted to hitch assembly 540 to form basket and hitch assembly 550. Hitch assembly 540 is constructed of structural members 231, 232. Vertical structural member 231 is welded to horizontal structural member 232 to form hitch assembly 540. The vertical structural member 231 of hitch assembly 250 is bolted to basket assembly 500 on at least two structural members. Vertical and horizontal structural members 231, 232 of hitch assembly 540 can be chosen from the set of standard structural shapes consisting of, but not limited to, angle, square tube, round tube, channel, etc. In addition, the vertical and horizontal structural members 231, 232 of hitch assembly 540 can be from the set of materials consisting of, but not limited to, carbon steel, alloy steel, stainless steel, aluminum, etc. Horizontal structural member 232 includes a hole that is aligned with a hole in a vehicle receiver hitch (not shown), or a wall mount receiver hitch 800 as described in FIG. 8, or a free standing receiver hitch 900 as described in FIG. 9, in order for a hitch pin to be inserted to connect the basket and hitch assembly 550 of the present invention to a receiver hitch on a vehicle, or a wall mount receiver hitch 800 as described in FIG. 8, or a free standing receiver hitch 900 as described in FIG. 9.

The bolted or pinned connections in FIG. 5 can be constructed as described in FIG. 6 and FIG. 7 as follows.

FIG. 6 is an exploded diagram that describes how structural members are bolted or pinned together vertically. The vertically oriented connection for the longitudinal and transverse structural members 601, 602 that intersect for the purpose of making a bolted connection can be chosen from the set of standard structural shapes consisting of, but not limited to, angle, square tube, round tube, channel, etc. In addition, the material for structural members 601, 602 can be chosen from the set consisting of, but not limited to, carbon steel, alloy steel, stainless steel, aluminum, etc. Longitudinal and transverse structural members 601, 602 have holes 603A, 603B. Holes 603A, 603B may be drilled, punched or cut into the longitudinal and transverse structural members 601, 602. Holes 603A, 603B are aligned during assembly in order to allow bolt 604 to be inserted through the holes 603A, 603B and tightened appropriately with nut 605 to form a bolted connection. An optional lock washer (not shown) may be used with bolt 604 and nut 605 in order to bolt the structural members together.

FIG. 7 is an exploded diagram that describes how structural members are bolted or pinned together horizontally. The horizontally oriented connection for the longitudinal and vertically oriented transverse structural members 701, 702 in this example, intersect for the purpose of making a bolted connection, and can be chosen from the set of standard structural shapes consisting of, but not limited to, angle, square tube, round tube, channel, etc. (see In addition, the material for structural members 701, 702 can be chosen from the set consisting of, but not limited to, carbon steel, alloy steel, stainless steel, aluminum, etc. Longitudinal and transverse structural members 701, 702 have holes 703A, 703B. Holes 703A, 703B may be drilled, punched or cut into the horizontally oriented longitudinal and vertically oriented transverse structural members 701, 702. Holes 703A, 703B are aligned during assembly in order to allow bolt 604 to be inserted through the holes 703A, 703B and nut 605 tightened appropriately to form a bolted connection. An optional lock washer (not shown) may be used with bolt 604 and nut 605 in order to bolt the structural members together.

Figure 8:
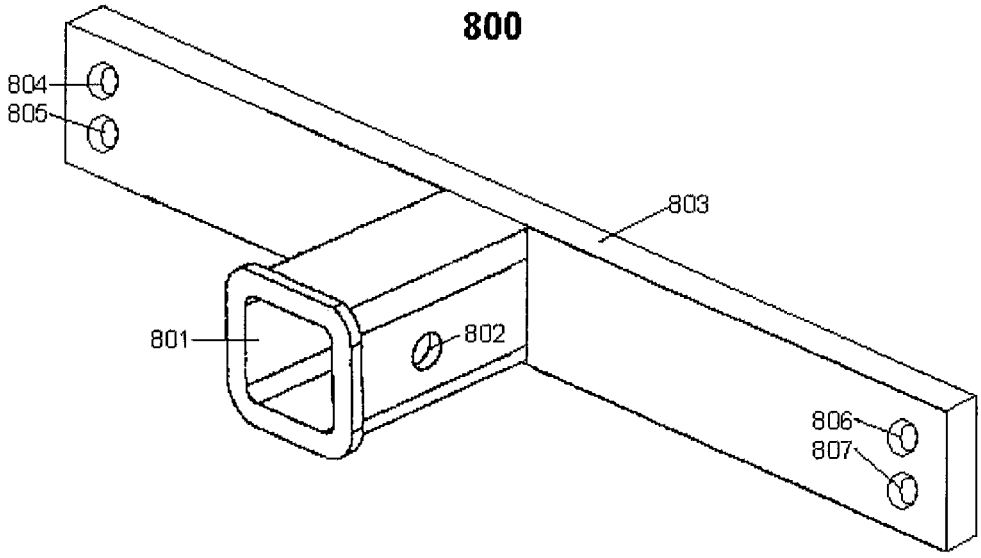
FIG. 8 is a graphic representation of a wall mount receiver hitch 800 for use with the various embodiments of the present invention.

FIG. 8 is a graphic representation of a wall mount receiver hitch 800 for use with the various embodiments of the present invention.

Wall mount receiver hitch 800 consists of two parts, receiver hitch 801, and mounting plate 803.

Receiver hitch 801 is welded to mounting plate 803. Receiver hitch 801 includes a hole 802 for securing the present invention illustrated in FIGS. 1A, 2, 3, 4, and 5 with a hitch pin (not shown).

Mounting plate 803 includes four holes 804, 805, 806, 807. Holes 804 and 805 are located near one end of mounting plate 803. Holes 806 and 807 are located at the other end of mounting plate 803. The center-of-holes 804 and 805 to the center-of-holes 806 and 807, respectively, is dimensioned so the wall mount receiver hitch 800 can be secured to a pair of wall studs in a building. Typically, this dimension would be 16 inches on centers, but the present invention is not limited to this dimension, as any other suitable dimension for securing the wall mount receiver hitch 800 to a wall would also be acceptable.

Figure 9:
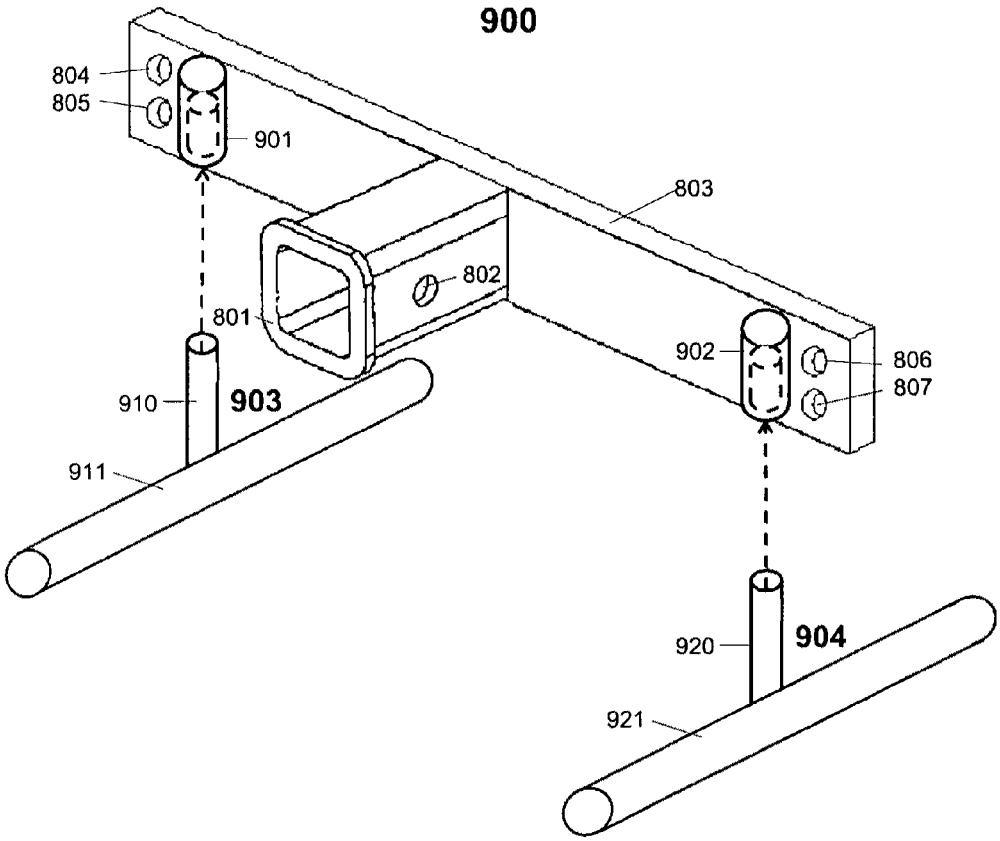
FIG. 9 is a graphic representation of a free standing receiver hitch 900 for use with the various embodiments of the present invention.

FIG. 9 is a graphic representation of a free standing receiver hitch 900 for use with the various embodiments of the present invention. Free standing hitch 900 is designed to be either wall mounted or free standing.

Figure 10:
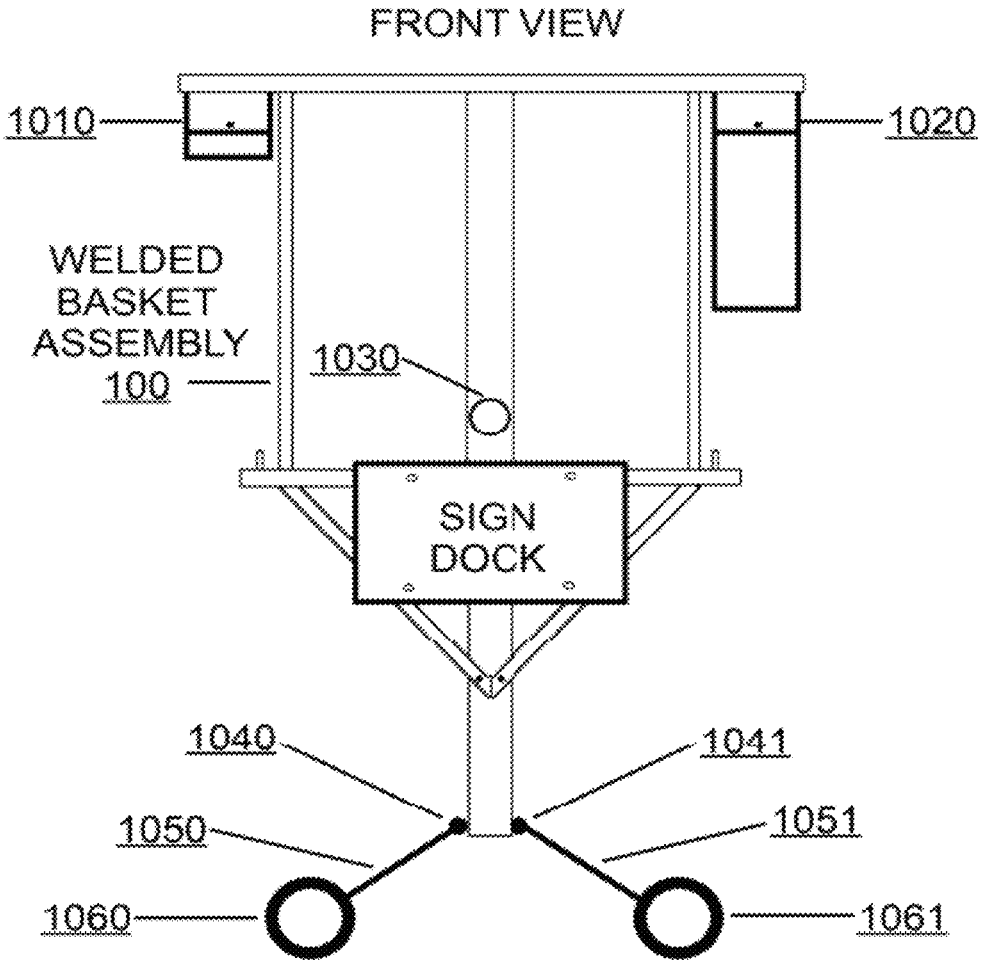
FIG. 10 is a graphic representation of the front view of a welded basket assembly illustrating optional tool pouch, optional sign rider pouch, optional safety reflector, and optional wheels on foldable legs.

FIG. 10 is a graphic representation of the front view of a welded basket assembly 100 described in FIG. 1, which also illustrates optional tool pouch 1010, optional sign rider pouch 1020, optional reflector 1030, two optional down wheel assemblies, which are comprised of hinges 1040, 1041; structural members 1050, 1051; and wheels 1060, 1061. The welded basket assembly 100 as described in FIG. 1 includes main upright 107 to which hinges 1040, 1041 are attached. Structural members 1050, 1051 are operatively connected to hinges 1040, 1041 respectively. Wheels 1060, 1061 are operatively connected to structural members 1050, 1051 respectively.

Free standing receiver hitch 900 consists of a receiver hitch 801, mounting plate 803, tubes 901, 902, and leg assemblies 903, 904.

Receiver hitch 801 is welded to mounting plate 803. Receiver hitch 801 includes a hole 802 for securing the present invention illustrated in FIGS. 1A, 2, 3, 4, and 5 with a hitch pin (not shown).

Mounting plate 803 also includes tubes 901, 902. Tubes 901, 902 are illustrated as circular cross-section tubing, but can be any other cross-section of tubing such as, but not limited to, square, rectangular, etc. Tubes 901, 902 are welded to mounting plate 803.

Mounting plate 803 includes four holes 804, 805, 806, 807. Holes 804 and 805 are located near one end of mounting plate 803. Holes 806 and 807 are located at the other end of mounting plate 803. The center-of-holes 804 and 805 to the center-of-holes 806 and 807, respectively, is dimensioned so the wall mount receiver hitch 800 can be secured to a pair of wall studs in a building. Typically, this dimension would be 16 inches on centers, but the present invention is not limited to this dimension, as any other suitable dimension for securing the wall mount receiver hitch 800 to a wall would also be acceptable.

The wall mount receiver with tubes 901, 902 previously described in FIG. 9 can be converted into a free standing receiver by inserting leg assemblies 903, 904 into tubes 901, 902 respectively to provide the ability for the wall mounted assembly with tubes to serve as a free standing receiver hitch 900.

Leg assembly 903 consists of a vertical member 910 attached to a horizontal member 911. The leg assembly can be welded or bolted together. Vertical member 910 is sized appropriately to be capable of being inserted into tube 901.

Leg assembly 904 consists of a vertical member 920 attached to a horizontal member 921. The leg assembly can be welded or bolted together. Vertical member 920 is sized appropriately to be capable of being inserted into tube 902.

Options

One option for the present invention is the provision of a plate attached to the basket assembly that can hold a magnetic advertising sign.

Another option for the present invention is the provision of a vertical adjustment to the basket assembly.

Another option for the present invention is the provision of a width adjustment making the basket assembly expandable.

Another option of the present invention is the provision of safety reflectors or reflective tape. A reflector, which is sometimes called a "retro reflector", is a product that actually reflects light from a source back. The light source can be headlights or a flashlight. The reflector can be a hard plastic part, a sheet of reflective material, or soft vinyl reflective film fabricated into an unlimited variety of shapes. There are prismatic reflectors and glass bead reflectors, but both reflect light sufficiently to make the wearer visible in the dark up to 500 feet away from the light source, or more.

Another option of the present invention is the provision of lights.

Another option of the present invention is the provision of a license plate frame, which also can be lighted.

Another option of the present invention is the provision for hinging the basket assembly frame to allow the basket assembly and frame to swing away from the vehicle around a vertical axis. U.S. Pat. No. 6,237,823 to Stewart, et al describes a swing away method for hitch supported carriers, such as the present invention, and is herein included in its entirety.

Another option of the present invention is the provision for the basket assembly frame to move away from the vehicle by telescoping out.

Another option of the present invention is the provision for a receiver hitch-size adapter to adapt the receiver hitch size from 2" to 1-¼" or from 1-¼" to 2".

Another option of the present invention is the provision of a hinged front structural member for use as a gate that allows easy access to the signs stored in a welded or bolted basket.

Another option of the present invention is the provision of a hinged side structural member for use as a gate that allows easy access to the signs stored in a welded or bolted basket.

Another option of the present invention is the provision of a solid or semi-solid basket inserts that make the welded or bolted open-sided basket useful for transporting items other than signs.

Another option of the present invention is the provision of a welded or bolted basket assembly that is painted.

Another option of the present invention is the provision of a welded or bolted basket assembly that is plated.

Another option of the present invention is the provision of a welded or bolted basket assembly that is anodized.

Another option of the present invention is the provision of a welded or bolted basket assembly that is powder coated.

Another option of the present invention is the provision of a welded or bolted basket assembly that is rubber coated.

Another option of the present invention is the provision of a tool pouch that can be mounted and dismounted from the basket and hitch assembly.

Another option of the present invention is the provision of a sign rider pouch that can be mounted and dismounted from the basket and hitch assembly.

Another option of the present invention is the provision of a toolbox that can be mounted and dismounted from the basket and hitch assembly.

Another option of the present invention is the provision of a towel with grommets that can be attached to the basket and hitch assembly for cleaning hands, sign legs, etc.

Another option of the present invention is the provision of a flashing safety light to make a parked vehicle more visible to passing motorists.

Another option of the present invention is the provision of a scrolling marquee.

Another option of the present invention is the provision of a GPS unit which can used for marking the location of signs that have been placed for real estate, political, or other advertising.

Another option of the present invention is the provision of fold-down or drop down wheels mounted to the basket assembly for ease of mobility when the present invention is not mounted to a vehicle.

Another option of the present invention is the provision of handles mounted to the basket assembly to aid in movement of the basket assembly to and from the vehicle.

Having thus described a preferred embodiment and other embodiments of a basket apparatus for the hitch-mounted transportation of real estate and other like signs, it should be apparent to those skilled in the art that certain advantages of the present invention have been achieved. It should also be appreciated that various modifications, adaptations, and alternatives may be made. It is, of course, not possible to describe every conceivable combination of components for purposes of describing the present invention. All such possible modifications are to be included within the spirit and scope of the present invention which is to be limited only by the following claims.

What is claimed is:

1. A sign carrier for carrying signs for use with a vehicle having a receiver hitch, comprising;

a basket assembly and a ball mount assembly;

said ball mount assembly for attaching to the receiver hitch on a vehicle by sliding into an appropriate opening on the receiver hitch and being fastened thereto, said ball mount assembly comprised of a first horizontal piece of tubing attached to a first vertical piece of channel, said horizontal piece of tubing having a first end that slides into said receiver hitch having an appropriate opening, and one hole in opposite sides corresponding to a hole in opposite sides of a first vertical piece in said ball mount assembly, said holes for securing said ball mount assembly to said trailer hitch; said horizontal piece of tubing of said ball mount assembly having a second end attached to a first vertical piece of channel, said first vertical piece of channel having at least two holes in opposite sides for attaching said ball mount assembly to a first vertical piece of tubing of basket assembly having at least two holes in opposite sides, said holes for securing ball mount assembly to said basket assembly;

said first vertical piece of tubing of said basket assembly having a second end, said second end attached to an upper horizontal loop piece, said upper horizontal loop piece attached to a plurality of second vertical pieces of tubing, said plurality of second vertical pieces attached to a lower horizontal loop, said lower horizontal loop attached to first vertical piece of tubing, said lower horizontal loop also attached to a plurality of pieces of bar, said plurality pieces of bar having a first end, said first end attached to said lower horizontal loop, said plurality pieces of bar having a second end, said second end attached to first vertical piece.

2. The signs of claim 1 wherein said signs are real estate signs.

3. The sign carrier of claim 1 wherein a protective finish is chosen from the set consisting of: anodized, plated, painted, powder coated, rubber coated.

4. The sign carrier of claim 1 wherein at least one tool pouch is provided.

5. The sign carrier of claim 1 wherein at least one sign rider pouch is provided.

6. The sign carrier of claim 1 wherein at least one safety reflector is provided.

7. The sign carrier of claim 1 wherein is constructed of materials chosen from the set consisting of: steel, aluminum, stainless steel, plastic.

8. The sign carrier of claim 1 wherein wheels on foldable legs are provided and mounted to said lower horizontal loop for ease of mobility when said sign carrier has been removed from said vehicle.

9. The sign carrier of claim 1 wherein said basket assembly is adjustable in a vertical position with respect to said ball mount assembly, by the provision of at least one additional hole in said first vertical piece of tubing of said basket assembly.

10. The sign carrier of claim 1 wherein a means for attaching a license plate to said basket assembly is provided from the set consisting of bolting, welding, magnetic.

11. The sign carrier of claim 1 wherein a means for attaching a sign to said basket assembly is provided from the set consisting of bolting, welding, magnetic.

12. The signs of claim 1 wherein said signs are political yard signs.

13. The sign carrier of claim 1 wherein a removable container is inserted into open end of said basket assembly.

14. The sign carrier of claim 1 wherein all joints in said basket assembly are welded.

15. The sign carrier of claim 1 wherein all joints in said basket assembly are bolted.

16. The sign carrier of claim 1 wherein at least one of said joints in said basket assembly is welded.

17. The sign carrier of claim 1 wherein at least one of said joints in said basket assembly is bolted.

18. The sign carrier of claim 1 wherein said first end of said horizontal piece of tubing of said ball mount assembly includes a means to adapt from a horizontal piece of tubing size of 2 inches to a receiver hitch tubing size of 1¼ inches.

19. The sign carrier of claim 1 wherein said first end of said horizontal piece of tubing of said ball mount assembly includes a means to adapt from a horizontal piece of tubing size of or from 1¼ inches to a receiver hitch tubing size of 2 inches.

20. The sign carrier of claim 1 wherein the said basket assembly joints are hinged so as to be capable of folding down for storage or shipping.

21. A sign carrier for carrying signs for use with a wall mount receiver hitch, comprising a basket assembly and a ball mount assembly;

said ball mount assembly for attaching to said wall mount receiver hitch by sliding into an appropriate opening on the receiver hitch and being fastened thereto, said ball mount assembly comprised of a first horizontal piece of tubing attached to a first vertical piece of channel, said horizontal piece of tubing having a first end that slides into said wall mount receiver hitch having an appropriate opening, and one hole in opposite sides corresponding to a hole in opposite sides of a first vertical piece in said ball mount assembly, said holes for securing said ball mount assembly to said wall mount receiver hitch; said horizontal piece of tubing of said ball mount assembly having a second end attached to a first vertical piece of channel, said first vertical piece of channel having at least two holes in opposite sides for attaching said ball mount assembly to a first vertical piece of tubing of basket assembly having at least two holes in opposite sides, said holes for securing ball mount assembly to said basket assembly;

said first vertical piece of tubing of said basket assembly having a second end, said second end attached to an upper horizontal loop piece, said upper horizontal loop piece attached to a plurality of second vertical pieces of tubing, said plurality of second vertical pieces attached to a lower horizontal loop, said lower horizontal loop attached to first vertical piece of tubing, said lower horizontal loop also attached to a plurality of pieces of bar, said plurality pieces of bar having a first end, said first end attached to said lower horizontal loop, said plurality pieces of bar having a second end, said second end attached to first vertical piece.

22. A sign carrier for carrying signs for use with a free standing receiver hitch, comprising a basket assembly and a ball mount assembly;

said ball mount assembly for attaching to said free standing receiver hitch by sliding into an appropriate opening on the receiver hitch and being fastened thereto, said ball mount assembly comprised of a first horizontal piece of tubing attached to a first vertical piece of channel, said horizontal piece of tubing having a first end that slides into said free standing receiver hitch having an appropriate opening, and one hole in opposite sides corresponding to a hole in opposite sides of a first vertical piece in said ball mount assembly, said holes for securing said ball mount assembly to said free standing receiver hitch;

said horizontal piece of tubing of said ball mount assembly having a second end attached to a first vertical piece of channel, said first vertical piece of channel having at least two holes in opposite sides for attaching' said ball mount assembly to a first vertical piece of tubing of basket assembly having at least two holes in opposite sides, said holes for securing ball mount assembly to said basket assembly;

said first vertical piece of tubing of said basket assembly having a second end, said second end attached to an upper horizontal loop piece, said upper horizontal loop piece attached to a plurality of second vertical pieces of tubing, said plurality of second vertical pieces attached to a lower horizontal loop, said lower horizontal loop attached to first vertical piece of tubing, said lower horizontal loop also attached to a plurality of pieces of bar, said plurality pieces of bar having a first end, said first end attached to said lower horizontal loop, said plurality pieces of bar having a second end, said second end attached to first vertical piece.

* * * * *